US009702361B2

(12) United States Patent
Tanigawa et al.

(10) Patent No.: US 9,702,361 B2
(45) Date of Patent: Jul. 11, 2017

(54) CLAW PUMP WITH RELIEF SPACE

(75) Inventors: Shiro Tanigawa, Yokohama (JP); Takahiro Kagami, Yokohama (JP)

(73) Assignee: ANEST IWATA CORPORATION, Kanagawa (JP)

( * ) Notice: Subject to any disclaimer, the term of this patent is extended or adjusted under 35 U.S.C. 154(b) by 499 days.

(21) Appl. No.: 14/347,406

(22) PCT Filed: Jul. 9, 2012

(86) PCT No.: PCT/JP2012/067466
§ 371 (c)(1),
(2), (4) Date: Mar. 26, 2014

(87) PCT Pub. No.: WO2013/046852
PCT Pub. Date: Apr. 4, 2013

(65) Prior Publication Data

US 2014/0227122 A1 Aug. 14, 2014

(30) Foreign Application Priority Data

Sep. 30, 2011 (JP) ..... 2011-216393

(51) Int. Cl.
*F04C 18/08* (2006.01)
*F01C 21/10* (2006.01)
(Continued)

(52) U.S. Cl.
CPC ..... *F04C 18/08* (2013.01); *F01C 21/08* (2013.01); *F01C 21/108* (2013.01);
(Continued)

(58) Field of Classification Search
CPC F04C 18/123; F04C 2270/12; F04C 29/0035; F04C 19/06; F04C 18/08; F01C 21/08
(Continued)

(56) References Cited

U.S. PATENT DOCUMENTS

| | | | |
|---|---|---|---|
| 3,472,445 | A | 10/1969 | Brown |
| 4,406,601 | A | 9/1983 | Towner |
| 2012/0257961 | A1 | 10/2012 | Tanigawa |

FOREIGN PATENT DOCUMENTS

| | | |
|---|---|---|
| EP | 0 009 915 | 4/1980 |
| JP | 55-91702 | 7/1980 |

(Continued)

OTHER PUBLICATIONS

International Search Report issued Oct. 23, 2012 in International Application No. PCT/JP2012/067466.

(Continued)

*Primary Examiner* — Mary A Davis
(74) *Attorney, Agent, or Firm* — Wenderoth, Lind & Ponack, L.L.P.

(57) ABSTRACT

In a pump chamber (12), a male rotor (20) having claw portions and a female rotor (24) having recesses into which the claw portions enter are secured to rotating shafts (18*a* and 18*b*), respectively. The female rotor is provided with hollows on an upstream side in the rotational direction of the female rotor relative to a plane L containing the rotating shafts. For the hollows, the disposed position, size and configuration are selected so that a compression pocket P and a discharge opening remain in communication with each other through the hollow throughout the time from when the compression pocket stops communicating with the discharge opening and separates from the discharge opening until the compression pocket gradually reduces to disappear, and so that the hollow stops communicating with the discharge opening at the same time as the compression pocket disappears.

4 Claims, 7 Drawing Sheets

(51) Int. Cl.

| | |
|---|---|
| ***F01C 21/08*** | (2006.01) |
| ***F04C 18/12*** | (2006.01) |
| ***F04C 25/02*** | (2006.01) |
| ***F04C 29/00*** | (2006.01) |
| ***F04C 29/06*** | (2006.01) |

(52) U.S. Cl.
CPC ..... *F04C 18/086* (2013.01); *F04C 18/123* (2013.01); *F04C 25/02* (2013.01); *F04C 29/0035* (2013.01); *F04C 29/06* (2013.01); *F04C 2270/12* (2013.01)

(58) Field of Classification Search
USPC ..... 418/190
See application file for complete search history.

(56) References Cited

FOREIGN PATENT DOCUMENTS

| | | |
|---|---|---|
| JP | 62-23591 | 1/1987 |
| JP | 6-213181 | 8/1994 |
| JP | 2008-196353 | 8/2008 |
| JP | 2011-38476 | 2/2011 |
| JP | 2011-132869 | 7/2011 |

OTHER PUBLICATIONS

Extended European Search Report issued Jun. 3, 2015 in corresponding European patent application No. 12837198.6.

CLAW PUMP WITH RELIEF SPACE

TECHNICAL FIELD

The present invention relates to a claw pump having two rotors with hook-shaped claw portions. More particularly, the present invention relates to a claw pump configured to suppress or eliminate power loss and pulsation due to an over-compression pocket formed in the final stage of the compression process.

BACKGROUND ART

A claw pump has a housing forming as pump chamber and two claw-type rotors rotating in the housing in opposite directions to each other in a non-contact manner with a very narrow clearance kept between the rotors. The two claw-type rotors form to compression pocket, and a gas compressed in the compression pocket is discharged through a discharge opening. Suction, compression and exhaust are performed continuously without using either a lubricant or sealing liquid to create a vacuum condition or pressurized air. Because no lubricant or other liquid is used, it is possible to achieve clean evacuation and discharge. In addition, the claw pump has the following advantages. It is possible to realize a higher compression ratio than Roots pumps, which have no compression process. Because the rotors rotate in a non-contact manner, it is possible to readily realize energy-conservation pumping according to need by controlling the number of revolutions.

Patent Document 1 discloses the structure of such a claw pump. The inventors of the present invention have already proposed a multistage vacuum pump capable of suppressing pulsation and power fluctuation, using a claw pump (Patent Document 2).

FIG. 8 illustrates the structure of a conventional vacuum claw pump. In FIG. 8, a claw pump 100 has a pump chamber 102 comprising an outer peripheral wall 104 having an inner surface with a sectional configuration defined by two mutually overlapping circles. The pump chamber 102 further comprises two (front and rear) side walls 106 juxtaposed to the outer peripheral wall 104. It should be noted that the front side wall is not shown in the figure. Two rotating shafts 108*a* and 108*b* extend through the pump chamber 102 in parallel to each other. The rotating shaft 108*a* has a male rotor 110 secured thereto. The male rotor 110 has two radially projecting claw portions 112*a* and 112*b*. The rotating shaft 108*b* has a female rotor 114 secured thereto. The female rotor 114 has recesses 116*a* and 116*b* into which the claw portions 112*a* and 112*b* enter, respectively.

A suction opening 118 is provided on one side of a plane L containing the axes of the rotating shafts 108*a* and 108*b*, and a discharge opening 120 is provided on the other side of the plane L. Minute clearances are provided between the pair of rotors and between each rotor and the wall surface of the pump chamber 102. If the clearances are excessively large, back flow occurs in the pump chamber, causing a reduction in efficiency. On the discharge opening side of the plane L, a compression pocket P is formed being surrounded by the pair of rotors 110 and 114, the outer peripheral wall 104 and the side walls 106. As the male and female rotors 110 and 114 rotate in the directions of the arrows, respectively, the volume of the compression pocket P decreases progressively, and the gas in the compression pocket P is compressed correspondingly. At the time shown in FIG. 8(B), the discharge opening 120 is in communication with the compression pocket P, and the gas in the compression pocket P is discharged through the discharge opening 120.

At the time shown in FIG. 8(C), the opening area of the discharge opening 120 is reduced by the rotation of the male and female rotors 110 and 114, and the compression pocket P is also reduced. At the time shown in FIG. 8(D), the discharge opening 120 is closed, while the compression pocket P still exists. FIG. 8(D) shows that the compression is continued in the compression pocket P. In the final stage of the compression process, the volume of the compression pocket P becomes zero; therefore, the volume ratio (compression ratio) becomes infinite in terms of calculation.

CITATION LIST

Patent Document

Patent Document 1: Japanese Patent Laid-Open Publication No. 2011-038476

Patent Document 2: Japanese Patent Laid-Open Publication No. 2011-132869

SUMMARY OF INVENTION

Technical Problem

There are restrictions on the configuration of the distal end 120*a* of the discharge opening 120. That is, the distal end 120*a* has to be unavoidably rounded in terms of machining. For this reason, as shown in FIGS. 8(D) and (E), the compression pocket P remains even after the discharge opening 120 has been closed by the rotation of the female rotor 114, and the gas in the compression pocket P is compressed until the volume of the compression pocket P becomes zero. Accordingly, over-compression occurs. That is, there is temporarily a sharp rise in pressure in the compression pocket P, and the gas compressed and trapped in the compression pocket P escapes into another clearance pocket through the minute clearances between the rotors and between each rotor and the pump chamber.

When over-compression occurs in the compression pocket P, pulsation occurs, which causes noise and vibration. Further, a reaction force occurs in the direction opposite to the rotor rotating direction, which causes power loss. In addition, over-compression generates high heat of compression. This causes thermal expansion of the rotors, resulting in the disappearance of the minute clearances between the rotors and between each rotor and the pump chamber, which causes problems such as wear of the sliding portions. Further, in the case of a vacuum pump, if the gas compressed and trapped in the compression pocket P flows toward the suction opening side in a large quantity, the ultimate pressure deteriorates.

The present invention has been made in view of the above-described problems with the conventional technique, and an object of the present invention is to reduce or eliminate the occurrence of over-compression in the compression pocket by low-cost means, thereby solving the above-described problems.

Solution to Problem

To solve the above-described problems, the present invention provides a claw pump having a relief space formed upstream in the rotational direction of the second rotor relative to a plane containing the axes of the pair of rotating shafts. That is, the relief space is provided at a position where the relief space communicates with a compression pocket formed between the claw portion of the first rotor and the recess of the second rotor when the compression pocket separates from the discharge opening. With this structure, even if over-compression occurs as a result of decrease in the volume of the compression pocket after the compression pocket has separated from the discharge opening, the gas in the compression pocket can escape into the relief space; therefore, over-compression can be reduced. In addition, because the relief space is provided upstream in the rotational direction of the second rotor relative to the plane containing the axes of the pair of rotating shafts, the compressed gas in the compression pocket can be suppressed from escaping into a suction opening-side pocket through the minute clearance between the first rotor and the second rotor.

Accordingly, it is possible to suppress pulsation resulting from over-compression and to suppress vibration and noise caused by the occurrence of pulsation. In addition, it is possible to suppress power loss because there is no occurrence of reaction force, which would otherwise occur in the direction opposite to the rotor rotating direction. In addition, because it is possible to suppress the generation of high heat of compression due to over-compression, it is possible to prevent wear of the sliding portions of the rotors, which would otherwise be caused by the thermal expansion of the rotors. Further, in the case of a vacuum pump, the ultimate pressure will not deteriorate because there is no possibility that the gas compressed and trapped in the compression pocket may flow toward the suction opening side in a large quantity.

In the apparatus of the present invention, the relief space is preferably formed by a hollow provided in an opposing surface of the recess of the second rotor that faces the claw portion of the first rotor. With this structure, the relief space can be formed by a simple machining process. The hollow is formed to extend over a part or the whole range of the opposing surface of the recess in the plate thickness direction thereof. The configuration of the hollow may be, for example, an arcuate, angular or square, or other configuration and is not necessarily limited to a specific one.

The hollow is preferably provided to extend to a surface of the second rotor that faces the discharge opening, and the disposed position or the size and configuration of the hollow are preferably selected so that, when the compression pocket separates from the discharge opening, the compression pocket and the discharge opening are communicated with each other through the hollow, and that the hollow provides communication between the discharge opening and the compression pocket until the compression pocket disappears. By providing the hollow to extend to a surface of the second rotor that faces the discharge opening, it becomes possible for the hollow and the discharge opening to communicate with each other. Accordingly, even if over-compression occurs in the compression pocket after the compression pocket has separated from the discharge opening, the gas in the compression pocket can be allowed to escape into the discharge opening through the hollow.

If, in addition to the above-described structure, the hollow is disposed so as to separate from the discharge opening at the same time as the compression pocket disappears, it is possible to prevent the discharged gas from flowing back from the discharge opening toward the hollow after the compression pocket has disappeared. In a compression pump, there is a large pressure difference between the suction side and the discharge side, as compared to a vacuum pump; therefore, the degree of deterioration (reduction) in ultimate pressure caused by the back flow is correspondingly large. In this regard, deterioration (reduction) in ultimate pressure can be prevented by eliminating the back flow of the discharged gas from the discharge opening into another clearance pocket through the hollow. In the case of a vacuum pump also, the discharged gas may flow back into the subsequent compression pocket, causing a reduction in pump efficiency. Therefore, it is possible to prevent a reduction in pump efficiency by eliminating the back flow of the discharged gas.

In addition, the relief space may be formed by a hollow provided in the inner surface of a side wall constituting the pump chamber. With this structure, the relief space can be formed by a simple machining process. The sectional configuration of the hollow may be, for example, an arcuate, angular or other configuration and is not necessarily limited to a specific one.

The hollow is preferably provided downstream of the discharge opening in the rotational direction of the second rotor, and the disposed position, size, configuration, and so forth are preferably selected so that the hollow remains in communication with the compression pocket throughout the time from when the compression pocket separates from the discharge opening until the compression pocket disappears. With this structure, the gas in the compression pocket can be allowed to escape into the hollow throughout the time from when the compression pocket separates from the discharge opening until the compression pocket disappears. Thus, over-compression in the compression pocket can be reduced.

In addition to the above-described structure, the hollow is preferably disposed so as to be closed by the second rotor at the same time as the compression pocket disappears. With this structure, it is possible to suppress the discharged gas from flowing back from the discharge opening into another compression pocket through the hollow.

Advantages of Invention

The claw pump of the present invention has a relief space provided upstream in the rotational direction of the second rotor relative to a plane containing the axes of the rotating shafts at a position where the relief space communicates with a compression pocket formed between the first rotor and the second rotor when the compression pocket separates from the discharge opening. Therefore, it is possible to suppress the occurrence of over-compression in the compression pocket after the compression pocket has separated from the discharge opening by a simple and low-cost machining process. Accordingly, it is possible to suppress vibration, noise, power loss, and so forth resulting from over-compression, and also possible to suppress deterioration in ultimate pressure.

BRIEF DESCRIPTION OF DRAWINGS

FIG. 8 is a front view of a conventional claw pump, of which.

DESCRIPTION OF EMBODIMENTS

The present invention will be explained below in detail by using embodiments shown in the accompanying drawings. It should, however, be noted that the dimensions, materials, shape, relative dispositions, and so forth of the constituent components described in the following embodiments do not limit the scope of the present invention to themselves alone, unless specifically indicated otherwise.

First Embodiment

Figure 1:
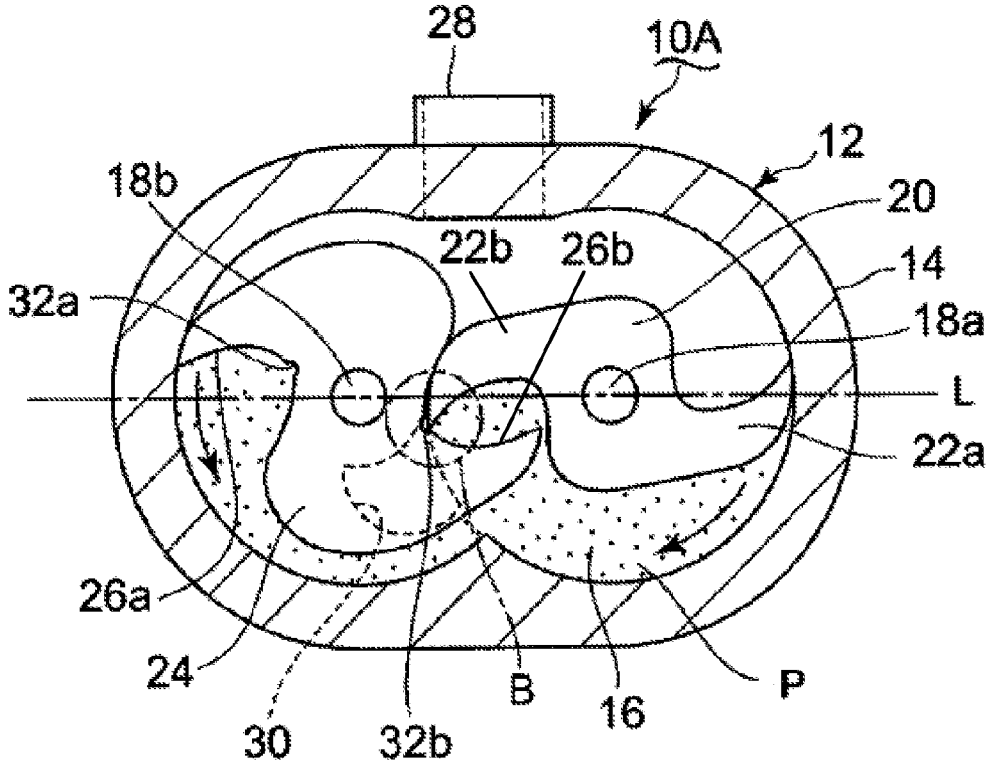
FIG. 1 is a front sectional view of a claw pump according to a first embodiment of the apparatus of the present invention.

A first embodiment in which the claw pump of the present invention is applied to an oil-free vacuum pump will be explained with reference to FIGS. 1 to 3. In FIG. 1, a claw pump 10A of this embodiment has as pump chamber 12 comprising an outer peripheral wall 14 having an inner surface with a sectional configuration defined by two mutually overlapping circles. The pump chamber 12 further comprises two (front and rear) side walls 16 juxtaposed to the outer peripheral wall 14 (front side wall is not shown in the figure). Two rotating shafts 18*a* and 18*b* extend in parallel to each other through bores provided in the front and rear side walls 16. The rotating shaft 18*a* has as male rotor 20 secured thereto. The male rotor 20 has two radially projecting claw portions 22*a* and 22*b*. The rotating shaft 18*b* has a female rotor 24 secured thereto. The female rotor 24 has recesses 26*a* and 26*b* into which the claw portions 22*a* and 22*b* enter, respectively.

A suction opening 28 is provided on one side of a plane L containing the axes of the rotating shafts 18*a* and 18*b*, and a discharge opening 30 is provided on the other side of the plane L. On the discharge opening side of the plane L, a compression pocket P is formed being surrounded by the mutually opposing surfaces of the claw portion 22*a* or 22*b* of the male rotor 20 and the recess 26*a* or 26*b* of the female rotor 24 and the outer peripheral wall 14, together with the side walls 16. As the male and female rotors 20 and 24 rotate in the directions of the arrows, respectively, the volume of the compression pocket P decreases progressively, and the gas in the compression pocket P is compressed correspondingly. Then, the discharge opening 30 is opened, and the gas in the compression pocket P is discharged through the discharge opening 30.

Figure 2A:
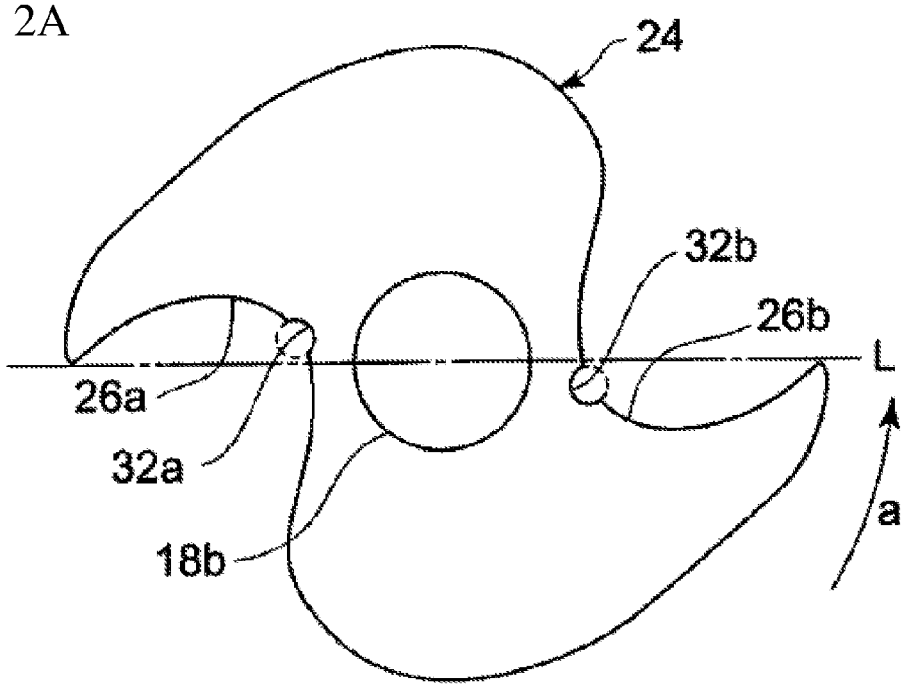
FIG. 2A is a front view of a female rotor of the claw pump according to the first embodiment.
Figure 2B:
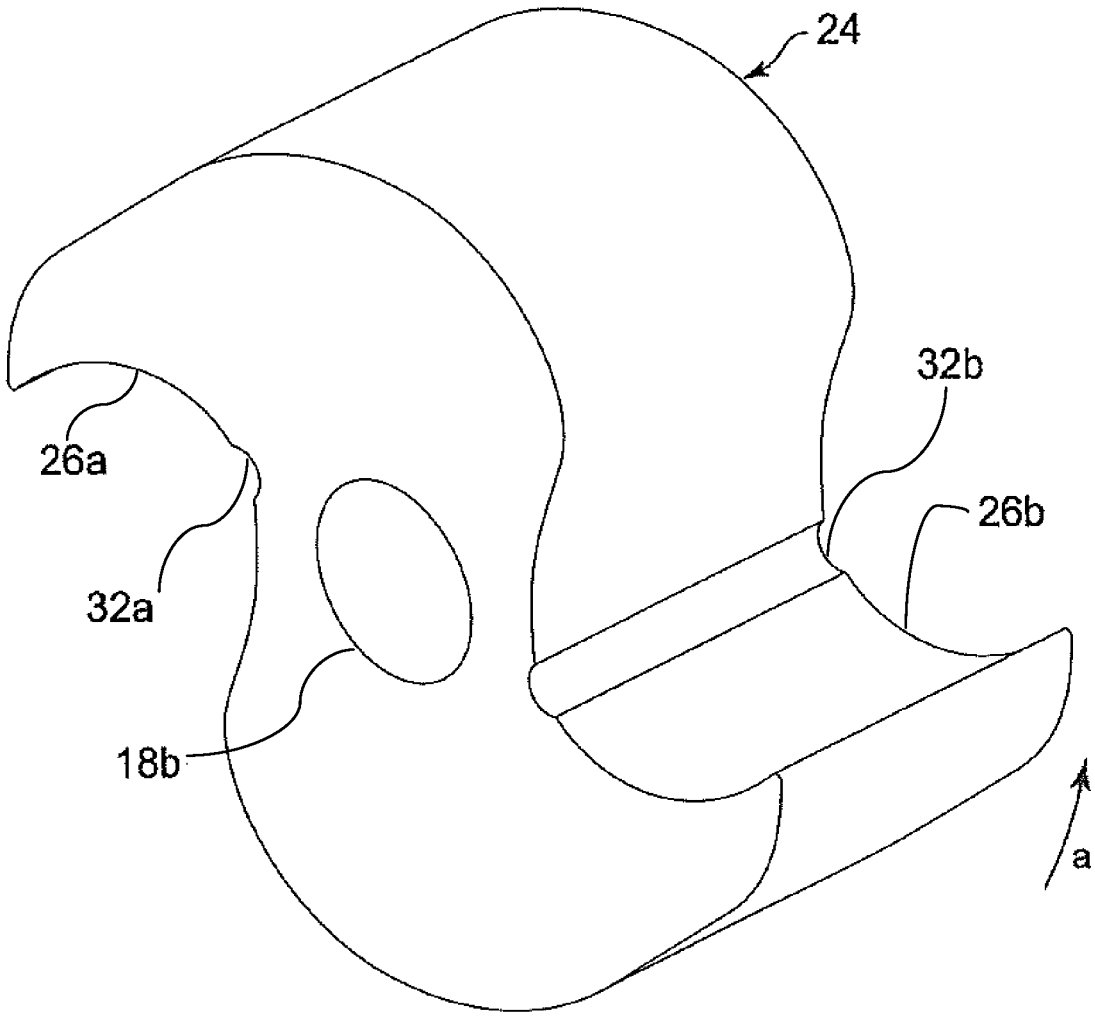
FIG. 2B is a perspective view of the female rotor of the claw pump according to the first embodiment.

FIGS. 2A and 2*b* show the structure of the female rotor 24 in this embodiment. The female rotor 24 has a recess 26*a* into which the claw portion 22*a* of the male rotor 20 enters, and a recess 26*b* into which the claw portion 22*b* of the male rotor 20 enters. In addition, the female rotor 24 has a hollow 32*a* provided in an opposing surface of the recess 26*a* that faces the claw portion 22*a*, and a hollow 32*b* in an opposing surface of the recess 26*b* that faces the claw portion 22*b*. The hollows 32*a* and 32*b* are provided upstream in the rotational direction "a" of the female rotor 24 relative to the plane L containing the axes of the rotating shafts 18*a* and 18*b*. The hollows 32*a* and 32*b* are formed in an arcuate configuration over the whole range of the female rotor 24 in the plate thickness direction of the female rotor 24. The arcuate configuration facilitates the hollow machining process using a cutting drill.

For the hollows 32*a* and 32*b*, the disposed position, size and configuration are selected so that the hollows 32*a* and 32*b* each provide communication between the compression pocket P and the discharge opening 30 in the final stage of the compression process and during the period from the time when the compression pocket P stops communicating with the discharge opening 30 and separates from the discharge opening 30 until the compression pocket P gradually reduces to disappear. Further, the disposed position, size and configuration of the hollows 32*a* and 32*b* are selected so that the hollows 32*a* and 32*b* each stop communicating with the discharge opening 30 and separate from the discharge opening 30 at the same time as the compression pocket P disappears.

Figure 3A:
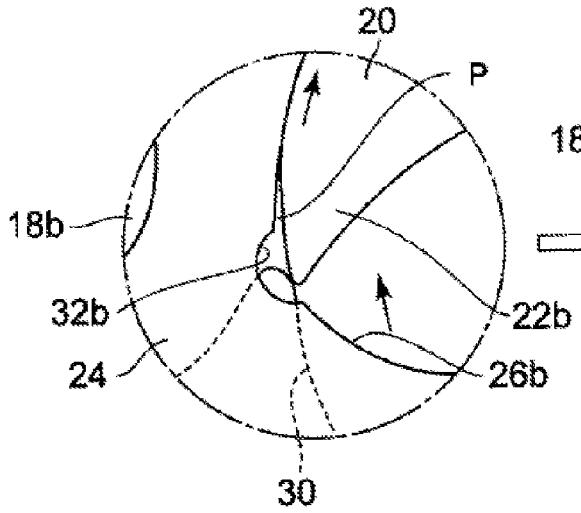
FIG. 3A is an enlarged view of part B in FIG. 1.
Figure 8A:
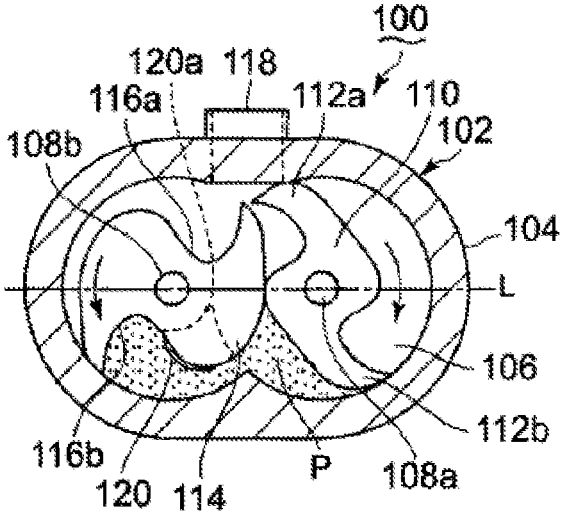
FIG. 8A to 8D show the rotation of rotors in time series.
Figure 8B:
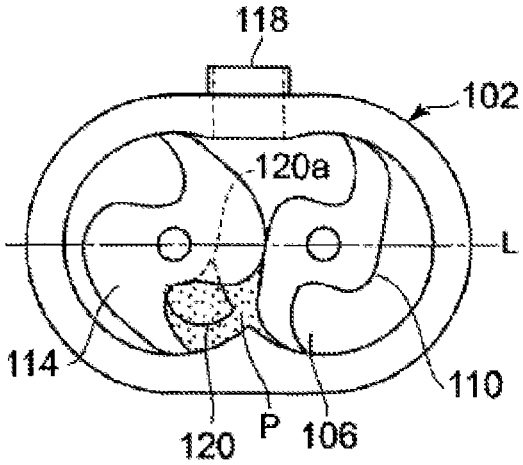
Figure 8C:
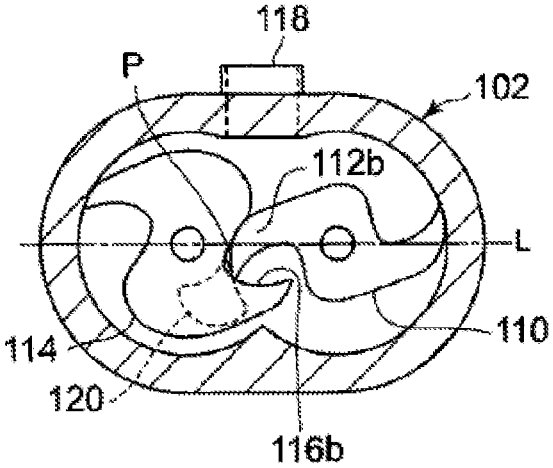
Figure 8D:
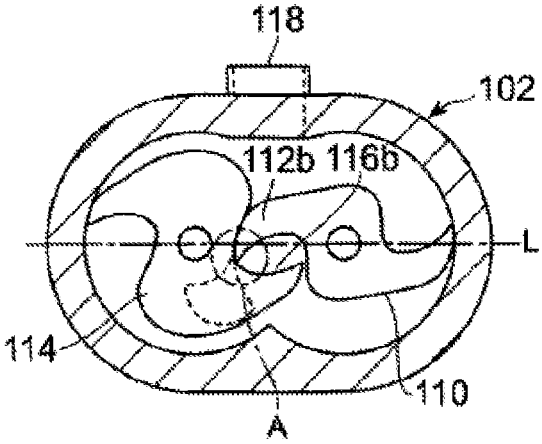
Figure 8E:
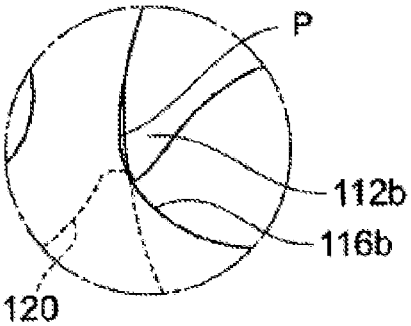
FIG. 8E is an enlarged view of part A in FIG. 8D.

FIGS. 1 and 3(A) correspond to FIGS. 8(D) and (E), respectively, in terms of the rotor operation timing, which show the final stage of the compression process of the compression pocket P. In the final stage of the compression process, the compression pocket P having reduced in volume separates from the discharge opening 30. In this embodiment, however, because the hollow 32*b* is provided, the compression pocket P is in communication with the discharge opening 30 through the hollow 32*b* while the compression pocket P remains. Therefore, the gas in the compression pocket P can escape into the discharge opening 30 through the hollow 32*b* as the volume of the compression pocket P decreases. Accordingly, there will be no occurrence of over-compression in the compression pocket P.

Figure 3B:
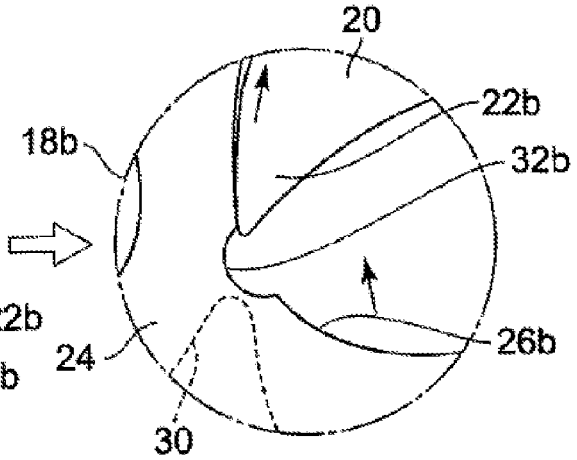
FIG. 3B is an enlarged view of part B after a compression pocket has disappeared.

FIG. 3(B) shows the instant when the compression pocket P has disappeared immediately after the state shown in FIG. 3(A). At the same time as the compression pocket P disappears, the hollow 32*b* and the discharge opening 30 separate from each other. For the hollow 32*a* also, the disposed position, size and configuration are selected so that the hollow 32*a* has the same function as the hollow 32*b*.

According to this embodiment, because the hollows 32*a* and 32*b* are provided, the compression pocket P remains in communication with the discharge opening 30 through the hollow 32*a* or 32*b* in the final stage of the compression process while the compression pocket P remains between the mutually opposing surfaces of the claw portion 22*a* or 22*b* of the male rotor 20 and the recess 26*a* or 26*b* of the female rotor 24. Therefore, there will be no occurrence of over-compression in the compression pocket P. Accordingly, it is possible to suppress pulsation caused by over-compression and to suppress vibration and noise caused by pulsation. It is also possible to suppress power loss due to as reaction force generated by over-compression.

In addition, because the hollows 32*a* and 32*b* are disposed on the upstream side relative to the plane L in the rotational direction of the female rotor 24, it is possible to suppress the gas over-compressed in the compression pocket P from flowing into a pocket in the pump chamber 12 at a side thereof closer to the suction opening 28. Accordingly, deterioration in ultimate pressure can be suppressed. It is also possible to suppress thermal expansion of the rotors due to the heat of compression generated by over-compression. Consequently, it is possible to prevent wear of the sliding portions of the rotors.

In addition, because the hollow 32*a* or 32*b* and the discharge opening 30 separate from each other at the same time as the compression pocket P disappears, there is no possibility of the discharged gas flowing back from the discharge opening 30 into the subsequent compression pocket. Accordingly, it is possible to prevent a reduction in pump efficiency of the vacuum pump.

Figure 4A:
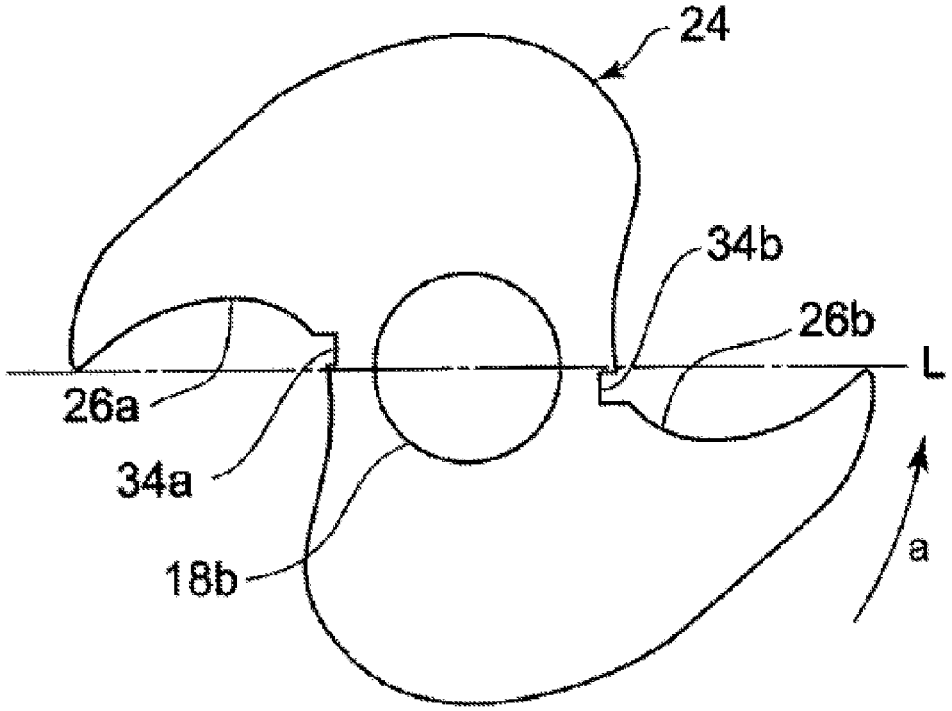
FIG. 4A is a front view showing a modification of the female rotor of the first embodiment.
Figure 4B:
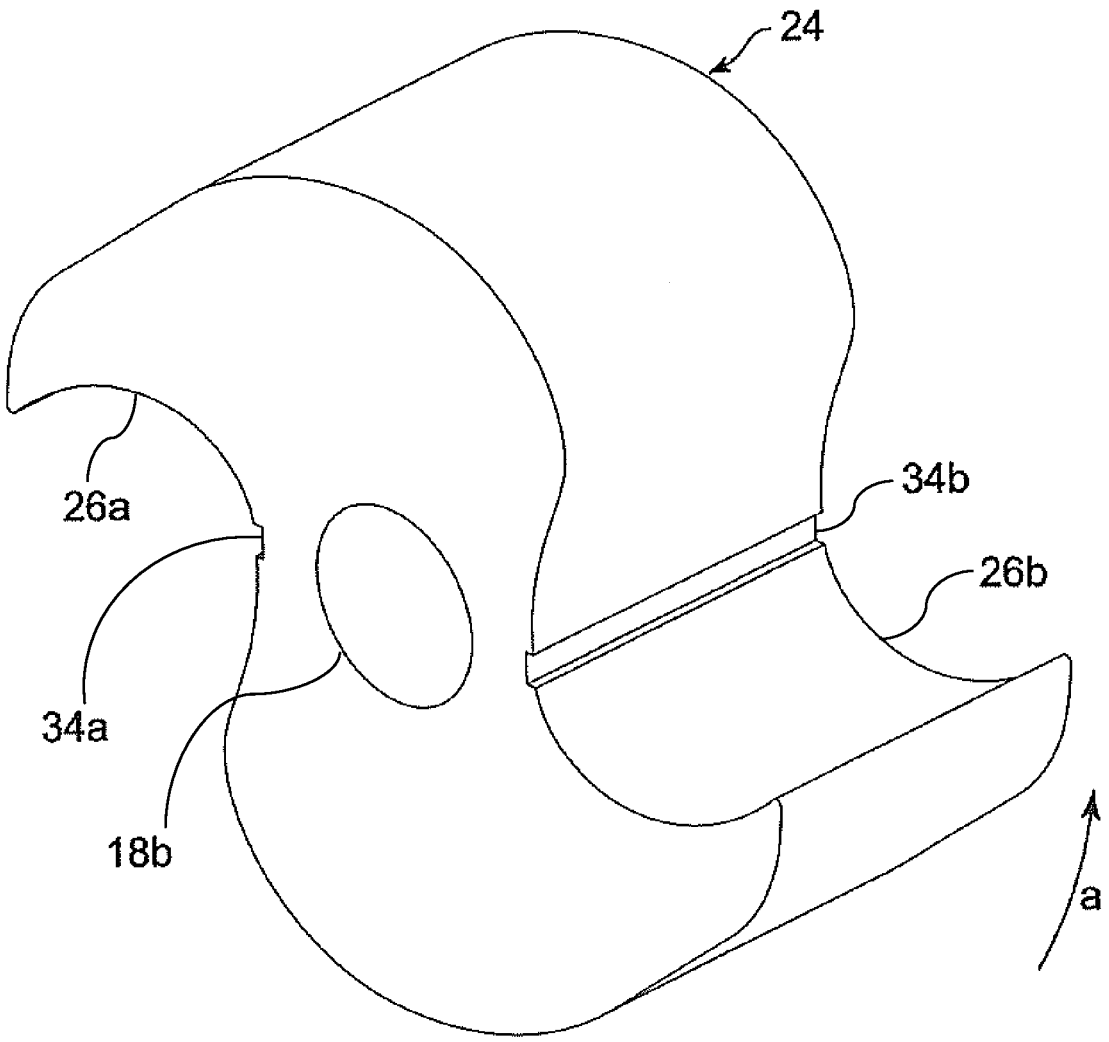
FIG. 4B is a perspective view showing the modification of the female rotor of the first embodiment.

FIGS. 4A and 4B show a modification of the hollows provided in the female rotor 24. In this modification, quadrangular hollows 34*a* and 34*b* are provided. The disposed positions of the hollows 34*a* and 34*b* are the same as the hollows 32*a* and 32*b* in the first embodiment. The modification also provides the same functions and advantages as the first embodiment.

Second Embodiment

Figure 5:
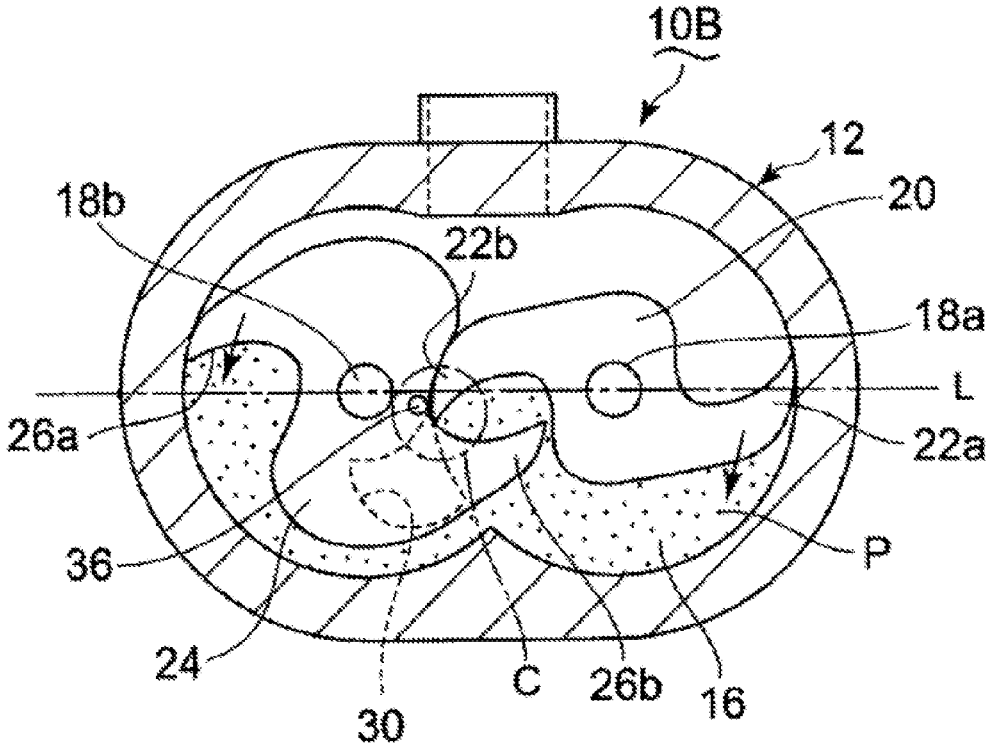
FIG. 5 is a front sectional view of a claw pump according to a second embodiment of the apparatus of the present invention.

Next, a second embodiment of the present invention will be explained with reference to FIGS. 5 to 7. In this embodiment also, the claw pump is applied to an oil-free vacuum pump as in the case of the first embodiment. The same parts or members as those of the first embodiment are denoted by the same reference signs as used in the first embodiment, and an explanation of the same parts or members is omitted because of redundancy. In a claw pump 10B of this embodiment, a hollow 36 is provided in the inner surface of the side wall 16 at a position upstream of the plane L in the rotational direction of the female rotor 24, i.e. at a position in the area between the rotating shafts 18*a* and 18*b* closer to the discharge opening 30 than the plane L. The hollow 36 has a circular outer periphery and a spherical curved surface. Such a configuration facilitates machining using a cutting drill.

Figure 6:
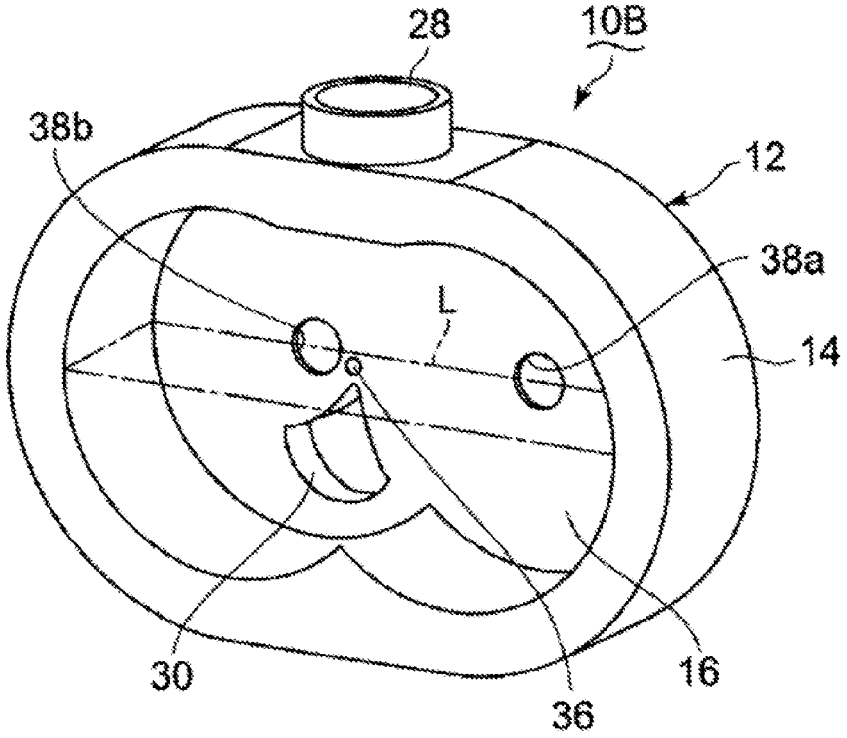
FIG. 6 is a perspective view of a pump chamber of the claw pump according to the second embodiment.

FIG. 6 shows the pump chamber 12 at the claw pump 10B according to this embodiment. The pump chamber 12 has the same structure as the pump chamber 12 in the first embodiment. In FIG. 6, the front side wall is omitted. The side wall 16 is provided with bores 38*a* and 38*b* through which the rotating shafts 18*a* and 18*b* extend, respectively.

For the hollow 36, the position, size and configuration are selected so that the hollow 36 remains in communication with the compression pocket P in the final stage of the compression process and during the period from the time when the compression pocket P, which remains between the mutually opposing surfaces of the claw portion 22*a* or 22*b* of the male rotor 20 and the recess 26*a* or 26*b* of the female rotor 24, separates from the discharge opening 30 until the compression pocket P disappears. In addition, the position, size and configuration of the hollow 36 are selected so that the whole area of the hollow 36 is closed by the female rotor 24 at the same time as the compression pocket P disappears.

Figure 7A:
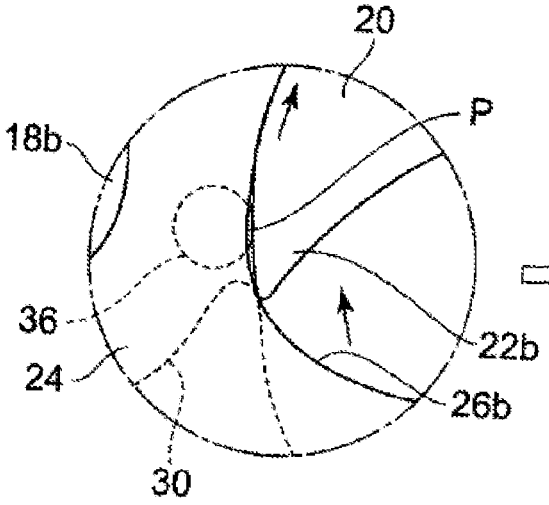
FIG. 7A is an enlarged view of part C in FIG. 1.

FIG. 7(A) corresponds to FIG. 3(A) in terms of the operation timing of the male and female rotors 20 and 24. When the compression pocket P decreases in volume and separates from the discharge opening 30 in the final stage of the compression process, the compression pocket P is in communication with the hollow 36. This state continues until the compression pocket P disappears. Therefore, the gas in the compression pocket P can escape into the hollow 36. Accordingly, over-compression in the compression pocket P can be reduced.

Figure 7B:
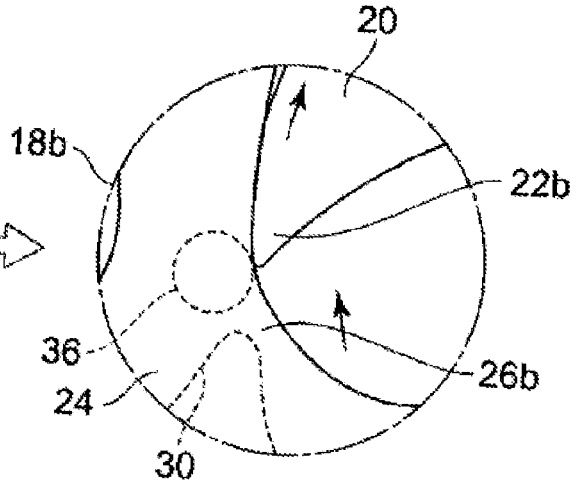
FIG. 7B is an enlarged view of part C after a compression pocket has disappeared.

FIG. 7(B) shows timing at which the compression pocket P disappears immediately after FIG. 7(A). The hollow 36 is closed by the female rotor 24 at the same time as the compression pocket P disappears. Therefore, it is possible to suppress the discharged gas from flowing back from the discharge opening 30 into another compression pocket through the hollow 36. Accordingly, it is possible to suppress reduction in pump efficiency of the claw pump 10B as a vacuum pump.

Although the above-described first and second embodiments are examples in which the claw pump of the present invention is applied to a vacuum pump, the present invention is also applicable to a claw pump for compression.

INDUSTRIAL APPLICABILITY

According to the present invention, it is possible to reduce over-compression in a compression pocket formed between rotors by simple and low-cost means and to suppress problems due to over-compression.

The invention claimed is:

1. A claw pump having a pair of mutually parallel rotating shafts rotating in opposite directions to each other, a pair of rotors secured to the pair of rotating shafts, respectively, the pair of rotors including a first rotor having a claw portion projecting in a radial direction and a second rotor having a recess into which the claw portion enters, a pump chamber accommodating the pair of rotors, a suction opening formed in the pump chamber on one side of a plane containing axes of the pair of rotating shafts, and a discharge opening formed in the pump chamber on an other side of the plane, the claw pump comprising:

a relief space formed by a hollow provided in an opposing surface of the recess of the second rotor which faces the claw portion of the first rotor, the hollow extending across the entire thickness of the second rotor, the relief space communicating with a compression pocket formed between the claw portion of the first rotor and the recess of the second rotor when the compression pocket separates from the discharge opening, so that a compressed gas remaining in the compression pocket is allowed to escape into the relief space.

2. The claw pump of claim 1, wherein:

the hollow extends to a surface of the second rotor that faces the discharge opening, and the relief space formed by the hollow communicates with the discharge opening and the compression pocket when the compression pocket separates from the discharge opening and until the compression pocket disappears due to the rotation of the first and second rotor.

3. The claw pump of claim 2, wherein the hollow is disposed so as to separate from the discharge opening at a same time that the compression pocket disappears due to the rotation of the first and second rotor.

4. The claw pump of claim 1, wherein the hollow is disposed so as to remain in communication with the compression pocket throughout time from when the compression pocket separates from the discharge opening until the compression pocket disappears due to the rotation of the first and second rotor.

* * * * *